United States Patent [19]

Watanabe et al.

[11] 4,112,626

[45] Sep. 12, 1978

[54] AUTOMATIC DESEAMING APPARATUS FOR ELONGATE BLOCK OF METALLIC MATERIAL

[75] Inventors: Kazuo Watanabe, Ohbu; Toshio Endo, Nagoya; Katsuhiro Kojima, Chita, all of Japan

[73] Assignee: Daido Tokushuko Kabushiki Kaisha, Nagoya, Japan

[21] Appl. No.: 786,114

[22] Filed: Apr. 8, 1977

[51] Int. Cl.[2] ..... B24B 7/02

[52] U.S. Cl. ..... 51/35; 51/165.72; 144/2 M

[58] Field of Search ..... 51/165 R, 165.72, 165.71, 51/35, 34 E; 144/2 M

[56] References Cited

U.S. PATENT DOCUMENTS

| | | | |
|---|---|---|---|
| 3,587,195 | 6/1971 | Aspden | 51/35 |
| 3,676,959 | 7/1972 | Forster | 51/165 R |
| 3,822,632 | 7/1974 | Chigiotti | 144/2 M |
| 3,953,943 | 5/1976 | Nakaoka | 51/34 E |
| 3,992,826 | 11/1976 | Nakaoka | 51/165.72 |

FOREIGN PATENT DOCUMENTS

| | | |
|---|---|---|
| 37,858/74 | 4/1974 | Japan. |
| 26,884/74 | 3/1974 | Japan. |

*Primary Examiner*—Harold D. Whitehead
*Attorney, Agent, or Firm*—Stevens, Davis, Miller & Mosher

[57] ABSTRACT

An automatic deseaming apparatus for an elongate block of metallic material comprises a defect marking detector for detecting defect markings which consist of a material containing a fluorescent pigment and have been deposited on defects in the surface of the block, a defect marking position detector for detecting the positions of the defects, a memory for storing the positions of the defect markings which are within the entire area or a predetermined one of segmented areas of the surface of the block, and a grinding controller for controlling reciprocative grinding action in the direction of the longitudinal axis of the block according to the defect marking informations stored in the memory.

4 Claims, 12 Drawing Figures

(A)

(B)

(A)

(B)

(A)

(B)

AUTOMATIC DESEAMING APPARATUS FOR ELONGATE BLOCK OF METALLIC MATERIAL

BACKGROUND OF THE INVENTION

1. Field of the Invention

This invention relates to an apparatus for automatically grinding surface defects in an elongate block of metallic material such as a bloom and a billet, primarily after it is hot-rolled, and more particularly, to an automatic surface defect grinding apparatus capable of automatically carrying out a longitudinal grinding for the defective surface portion of such a bloom or billet which extends in the direction of the longitudinal axis of the bloom or billet and on which a defect marking has been deposited in a defect inspecting step.

2. Description of the Prior Art

A bloom or billet is manufactured by subjecting an ingot to, for example hot-scarfing, rolling the hot-scarfed ingot and finishing it to a predetermined gauge. In course of formation of an ingot, gas holes may be produced in the peripheral surface layer of the ingot. If the gas holes remain in the surface of the ingot even after it has been hot-scarfed, they tend to be extended in rolling and thus mature into defects on the surface of the billet extending in the direction of the longitudinal axis of the billet. Furthermore, such a longitudinally extending defect may be produced on the surface of a billet in rolling due to malfunction of the rolls in rolling stands. Such defects on the surface of a billet may cause cracking in some applications of the billet and thus are extremely harmful.

Heretofore, such defects on the surface of a billet have been removed by detecting the positions of the defects on the surface of the billet, manually or automatically, applying a defect marking of chalk, paint or the like to the surface of the billet at the detected positions, and manually grinding the marked portions of the surface of the billet by means of a grinding wheel in a deseaming step. This conventional method has required too much labor for deseaming.

Thus, it is an object of this invention to provide an automatic surface defect grinding apparatus capable of automatically and efficiently grinding defective portions on an elongate block of metallic material under a completely unattended condition.

SUMMARY OF THE INVENTION

According to the present invention, there is provided an automatic deseaming apparatus for an elongate block of metallic material characterized by a defect marking detector for detecting defect markings which consist of a material containing a fluorescent pigment which has been deposited on defects in the surface of said block, a defect marking position detector for detecting the positions of the defects, a memory for storing the positions of the defect markings which are within the entire area or a predetermined one of segmented areas of the surface of said block, and a grinding controller for controlling reciprocative grinding action in the direction of the longitudinal axis of said block according to the defect marking informations stored in said memory.

This invention will now be described in detail in connection with the preferred embodiment of the present invention by reference to the accompanying drawings.

BRIEF DESCRIPTION OF THE DRAWINGS

Referring now to FIG. 1, there is shown a prior art automatic deseaming apparatus wherein a defect marking detector 13 is adapted to detect a defect marking 15 which has been deposited on a billet 14 in an inspecting step and then transmit a defect marking signal through a delay circuit 12 to a controller for a grinding wheel 11 which is located at a certain distance from the marking detector 13, to thereby initiate a grinding action for the defective portion of the billet 14 on which the detected marking 15 has been deposited. In this apparatus, if the billet 14 is in the form of a round bar and only one grinding wheel is used, the billet 14 must be screw-driven, as indicated by arrows A and B. This is not efficient since in grinding the long defect on which the defect marking 15 has been deposited and which extends in the direction of the longitudinal axis of the billet 14, the grinding wheel 11 must be stopped from grinding the billet 14 for a waiting time $t_w$ from when a leading portion of the defect marking 15 moves away from under the grinding wheel 11 to when the following portion of the defect marking 15 comes under the grinding wheel 11. Generally, to completely remove a defect through only one grinding action, a high grinding pressure will be required. Grinding under such a high grinding pressure tends to result in a rough ground surface. For this reason, it is usual to remove a defect through two or more repetitive grinding actions. However, such a repetitive grinding system limits the rate of screw-driving of a material being ground. For example, in a system wherein grinding action is repeated N times for a given portion of a defect on a billet, the rate of screw-driving of the billet must be set so that the travelling distance per one revolution of the billet may be equal to one-Nth of the width of a grinding wheel used.

Figure 1:
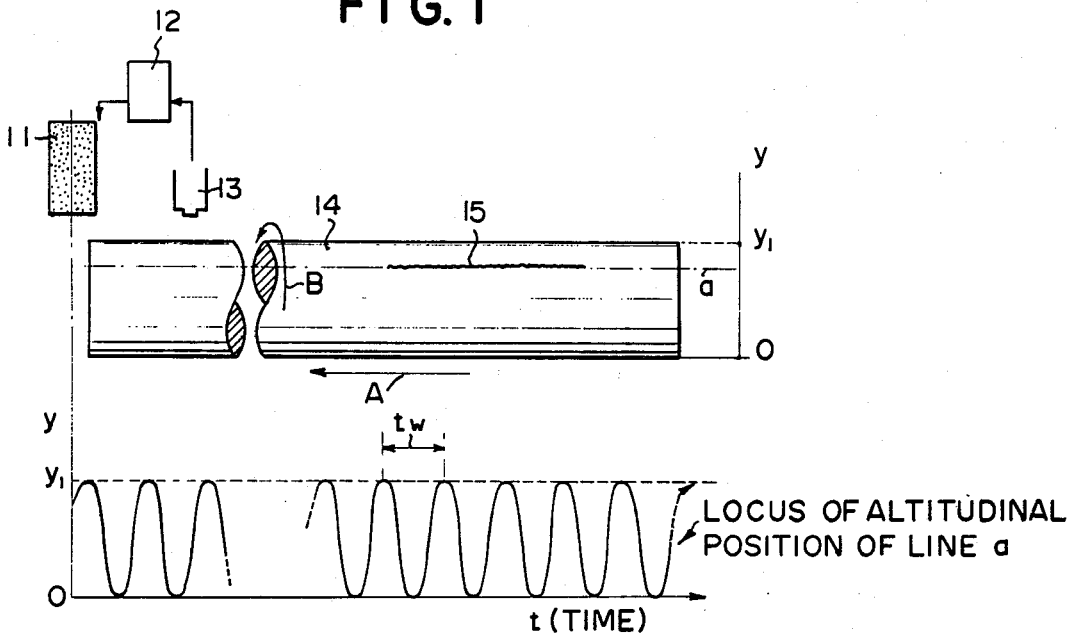
FIG. 1 diagrammatically shows a prior art automatic deseaming apparatus for an elongate material.

At such a rate of screw-driving, the waiting time $t_w$ will be very long. From this, it will be apparent that for a defect on a billet extending in the direction of the longitudinal axis of the billet longitudinal grinding is more efficient than transverse grinding as in the system of FIG. 1.

Figure 2:
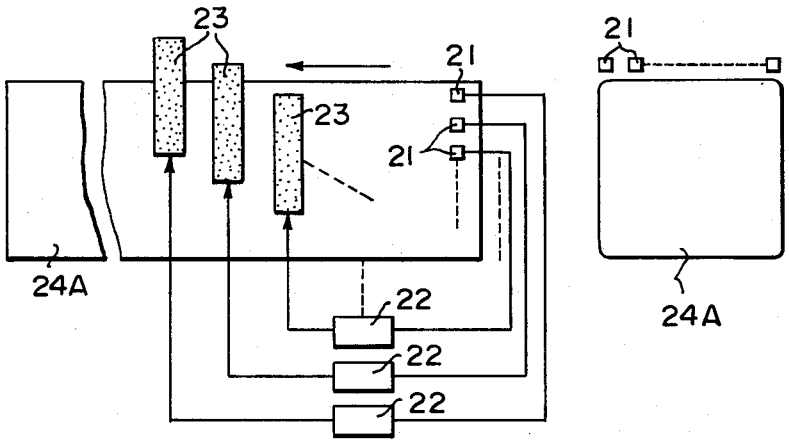
FIG. 2(A) diagrammatically shows another prior art automatic deseaming apparatus.
FIG. 2(B) diagrammatically shows still another prior art automatic deseaming apparatus.
Figure 2:
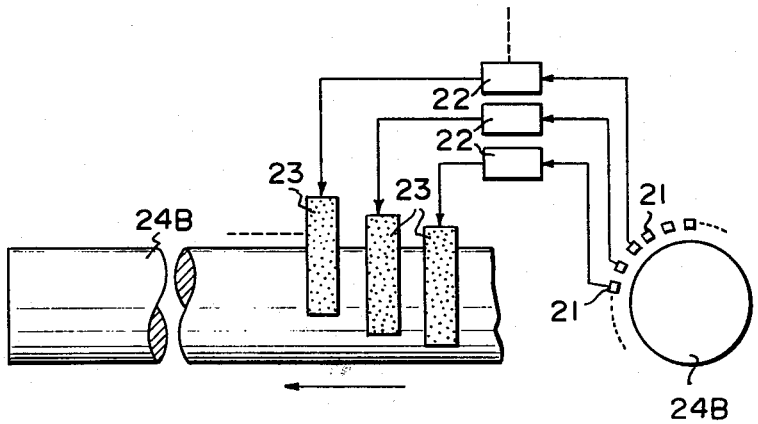

In FIG. 2(A), there is shown a prior art automatic deseaming apparatus capable of effecting such a longitudinal grinding wherein a rectangular bar billet 24A being deseamed is moved in the direction of the longitudinal axis of the billet. A plurality of defect marking detectors (or defect detectors) 21 and a plurality of grinding wheels 23 are provided, one for each of widthwise segmented area of the surface of the billet 24A. The grinding wheels 23 are located at certain distances from the corresponding detectors 21. Defect marking signals (or defect signals) from the detectors 21 can be transmitted to the corresponding controllers for the grinding wheels 23 through delay circuit 22. The delay circuits 22 serve to delay a marking or defect signal from the corresponding detectors 21 a period of time which allows the defect marking or defect detected by the corresponding detectors 21 to come under the corresponding grinding wheels 23.

In FIG. 2(B), there is shown a prior art automatic deseaming apparatus similar to the apparatus of FIG. 2(A), but adapted to be applied to a round bar billet 24B rather than a rectangular bar billet.

However, the apparatuses as shown in FIGS. 2(A) and (B) have a disadvantage as will be described hereinafter. In these apparatuses, a number of grinding wheel systems equal to the number of the segmented areas of the surface of a billet being deseamed need to be provided. On the other hand, it is usual that a billet has only a few defects, if any. In deseaming such a billet by means of these apparatuses, only a few of the grinding wheels of the apparatuses actually work to grind a few defects which would exist on the billet, but the remaining grinding wheels will be idle. This is not efficient.

DESCRIPTION OF THE PREFERRED EMBODIMENTS

Referring now to FIGS. 3(A) through (D), there is shown the defect detecting section of an embodiment of the automatic deseaming apparatus according to this invention. In this embodiment, a rectangular bar billet 31 being deseamed is placed on a platform car 32. The platform car 32 is movable in the direction of the longitudinal axis of the billet 31 firmly mounted thereon, together with the billet 31. A defect marking detector 33 is provided for the purpose of detecting defect markings on the surface of the billet 31. Although in this embodiment the detector 33 is fixed and the billet 31 is moved with respect to the fixed detector 33, in some cases the billet 31 may be fixed and the detector 33 may be moved with respect to the fixed billet 31.

In a defect inspecting step prior to a deseaming step as carried out by a automatic deseaming apparatus of this invention, a defect marking is applied to a defective portion of the surface of a billet. If the billet consists of a magnetic material, the defect marking may be formed by magnetizing the billet and applying a magnetic powder containing a fluorescent pigment to the defective portion of the surface of the billet. If the billet consists of a non-magnetic material such as austenite stainless steel, the defect marking may be formed by applying a fluorescent chalk to the defective portion of the surface of the billet. Since the fluorescent chalk marking is very handy and applicable to both of billets of magnetic materials and non-magnetic materials, it will be most desirable.

The defect marking detector 33 will now be described in detail with respect to FIG. 3(D).

A defect marking detecting system including the detector 33 is located within a dark-room. A black light 36 emits ultraviolet rays 361 to the surface of the billet to excite the fluorescent chalks of the markings deposited on the defects **31*b* in the billet surface 31a so as to generate fluorescent radiation. The defect marking detector 33 comprises a fluorescent chalk marking detecting plane 330 consisting of, for example 11 photoreceptor elements $y_1'$, $y_2'$, $y_3' \ldots y_{11}'$ spaced in alignment with one another and a lens system 331 for imaging the billet surface 31a onto the detecting plane 330. The lens system 331 may be arranged so that each of the photoreceptor elements $y_2'$ through $y_{11}'$ can view the corresponding one of widthwise equally segmented areas of the billet surface 31*a*, each of which areas has a width of, for example 15 mm. The platform car 32 is provided with billet fixing guides 310 each having a FIG. 311. The FIG. 311 serve to fix the billet 31 to the platform car 32. The surface of a corner edge 31*c* of the billet 31 may be imaged onto the photoreceptor element $y_1'$. Thus, the position of a defect marking on the billet surface along the width of the billet (hereinafter referred as to "lateral position") can be determined according to which of the photoreceptor elements $y_1'$, $y_2'$, $y_3' \ldots y_{11}'$ is detecting the defect marking. On the other hand, the position of the defect marking in the direction of the longitudinal axis of the billet (hereinafter referred as to "longitudinal position") can be determined by detecting the distance from the leading edge of the billet to under the defect marking detector. In this embodiment, the longitudinal position of the defect marking is determined by detecting the position of the platform car relative to the defect marking detector. More specifically, the platform car 32 is provided at one side thereof with a plate 37 having binary coding apertures spaced at certain intervals $\Delta x$. A platform car position detector 38 is provided for reading out the binary coding apertures of the plate 37, thereby detecting the longitudinal position of the platform car 32**.

Figure 3:
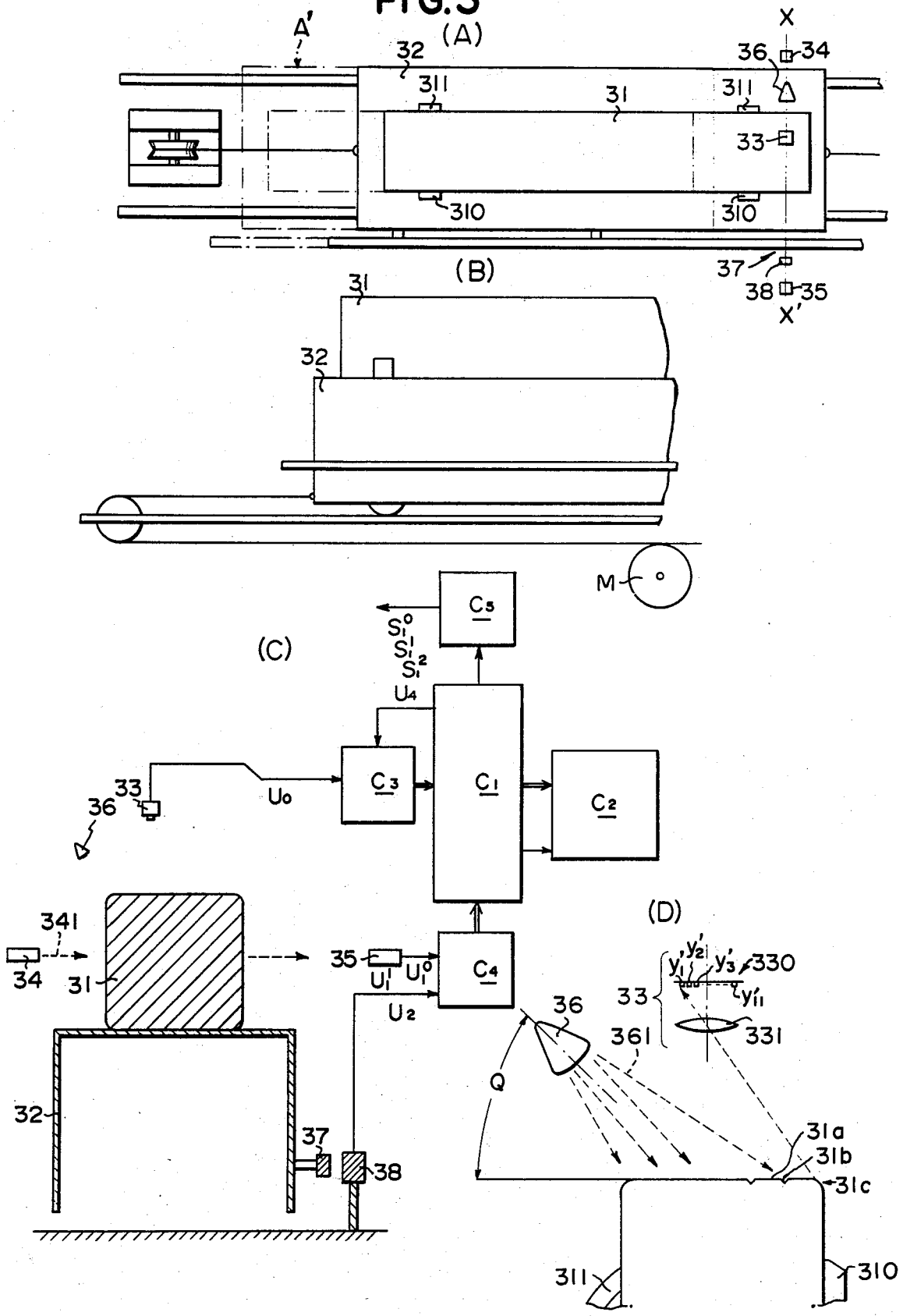
FIG. 3(A) is a plan view diagrammatically showing the detecting and storing sections of an embodiment of the automatic surface defect grinding apparatus according to this invention applied to a rectangular billet.
FIG. 3(B) is a side view of the system of FIG. 3(A)
FIG. 3(C) is a sectional view taken along the line X — X′ of FIG. 3(A), with an associated controlling circuit being diagrammatically shown.
FIG. 3(D) more specifically shows the defect marking detector of the apparatus of FIGS. 3(A) and (C)
Figure 4:
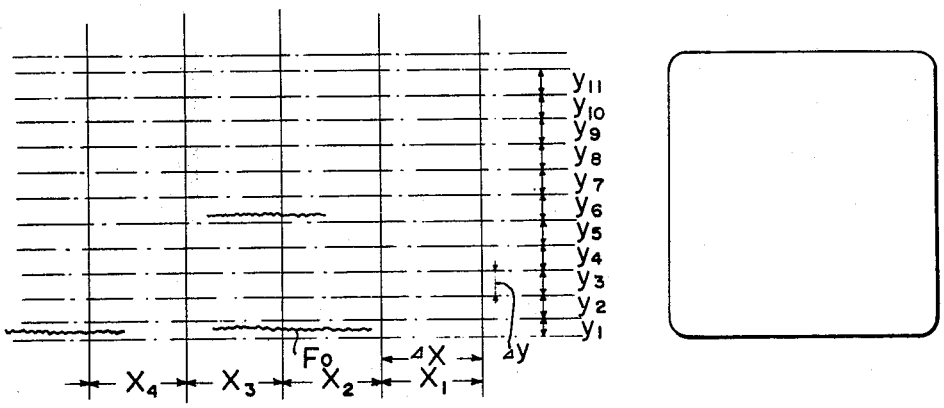
FIG. 4 shows X — Y coordinates representing the developed surface of a rectangular billet being deseamed.

In operation, as indicated by a phantom line A' in FIG. 3(A), a billet being deseamed is fed onto and secured to the platform car 32. Thereafter, a main controller $C_1$ as shown in FIG. 3(C) transmits a command signal $S_1$ to a driver for the platform car 32 to initiate the movement of the platform car 32 and thus the billet 31 to the right side in FIG. 3(A), namely toward the defect marking detector 33. As soon as the leading edge of the billet 31 enters the field of the defect marking detector 33, the detecting operation of the detector 33 may be started. This starting can be achieved in different ways. In this embodiment, as shown in FIG. 3(A), this is effected by means of an arrangement wherein a projector 34 emits infrared rays 341 (see FIG. 3(C)) to a receiver 35. When infrared rays 341 from the projector 34 to the receiver 35 is intercepted by the leading edge of the billet 31, the receiver 35 generates a billet detecting signal $U_1^I$ which in turn is transmitted through an interface $C_4$ to the main controller $C_1$ to thereby initiate detecting and storing operations for defect markings. At that time, the main controller $C_1$ transmits an initiating signal $U_4$ to an interface $C_3$ so that whenever the detector 33 detects a defect marking in the billet 31 to generate a defect marking signal $U_0$, the signal $U_0$ can be fed through the interface $C_3$ to the main controller $C_1$. Simultaneously, the platform car position detector 38 transmits platform car position signals or longitudinal position signals $U_2$ to the main controller $C_1$ through the interface $C_4$. When the main controller $C_1$ receives a defect marking signal $U_0$, it identifies which photoreceptor element has generated the signal $U_0$, thereby determining the lateral position of the defect marking corresponding to the signal $U_0$. Thus, the position of a defect on a billet can be stored in a memory $C_2$ as a point $(x_i, y_i)$ in X-Y cordinates representing the surface of the billet as shown in FIG. 4. In FIG. 4, $\Delta x$ indicates the intervals of the binary coding apertures of the plate 37 secured to the platform car 32, and $\Delta y$ indicates the width of the view of one photoreceptor element of in the detector 33. Practical values of $\Delta x$ and $\Delta y$ may be selected dependently on the width and length of the defect marking used. Generally, speaking, it is very difficult to manually apply fine defect markings on the spot. Moreover, even if an automatic marker is used, it is also very difficult to apply fine defect markings since most existing markers are limited in their performance. For these reasons, in practice it is impossible to apply a defect marking smaller than one having a width of 15 mm and a length of 30 mm. In view of this, in this embodiment, $\Delta x$ is made equal to 50 mm and $\Delta y$ equal to 15 mm.

When the trailing end of the billet 31 passes through the detector 33, infrared rays 341 from the projector 34 is received by the receiver 35 again. The receiver 35 transmits a billet passing signal $U_1^0$ to the main controller $C_1$ through the interface $C_4$. Then, the main controller $C_1$ transmits a car stopping signal $S_1^0$ through an interface $C_5$ to the driver M for the platform car to stop the platform car 32 from moving. This completes the operation of detecting the positions of all defects on the billet 31.

Before the billet is subjected to the following defect grinding step, the informations representative of the position of the portions of the defect markings and stored in the memory $C_2$ may be compiled to provide informations representative of the positions of the whole of each defect marking. The main controller $C_1$ may determine a sequence of grinding so that the total time necessary for a grinding wheel to successively move to all of the positions of the defect markings may be minimized. This improves the efficiency of grinding.

Figure 5:
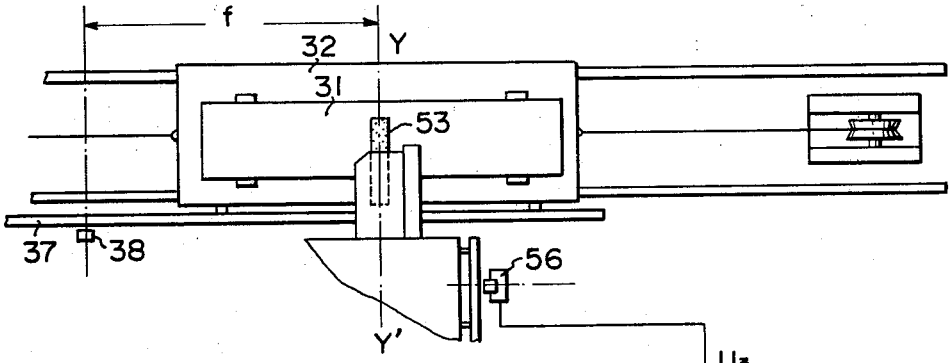
FIG. 5(A) is a plan view diagrammatically showing the grinding section of an embodiment of the automatic deseaming apparatus according to this invention applied to a rectangular billet.
FIG. 5(B) is a sectional view taken along the line Y — Y′ of FIG. 5(A), with an associated controlling circuit being diagrammatically shown.
Figure 5:
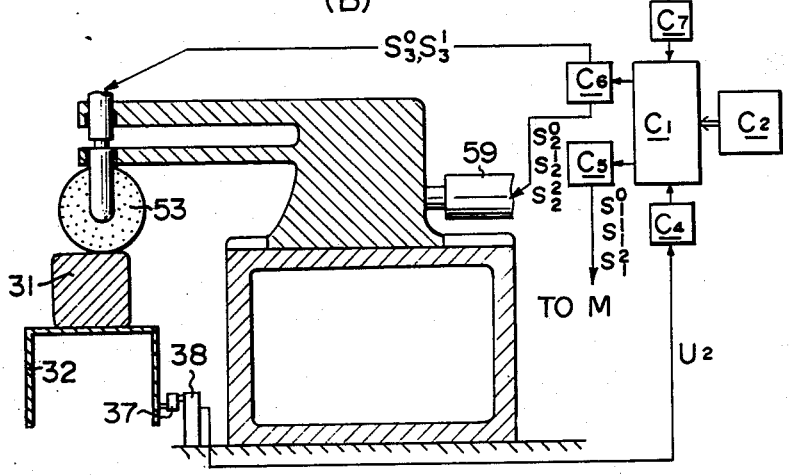

The grinding operation of this embodiment will now be described in connection with FIGS. 5(A) and (B) and FIGS. 6(A) and (B).

As shown in FIGS. (A) and (B), the defect grinding system comprises a signal grinding wheel 53. Since according to this invention the positions of all defect markings are stored before grinding operation is started, it is possible to use the single grinding wheel for grinding all of the defects on the entire surface of the billet. If the billet is very long, a plurality of grinding wheels may be provided, one for each of lengthwise segmented areas of the entire surface of the billet. Since each grinding wheel can be used for grinding all of the defects within the corresponding one of the segmented areas of the surface of the billet, the number of grinding wheels required in this arrangement is minimized for a given length of billet.

The number of times of grinding may be set by the main controller $C_1$, taking into account the degree of deseaming, the material of the billet being deseamed and the type of the grinding wheel used. Since the contacting area between the grinding wheel and the corner edges of the billet being ground is smaller as compared with that between the grinding wheel and the flat surface of the billet, the number of times of grinding in the corner edges of the billet should be set to be smaller than that in the flat surface of the billet.

Figure 6:
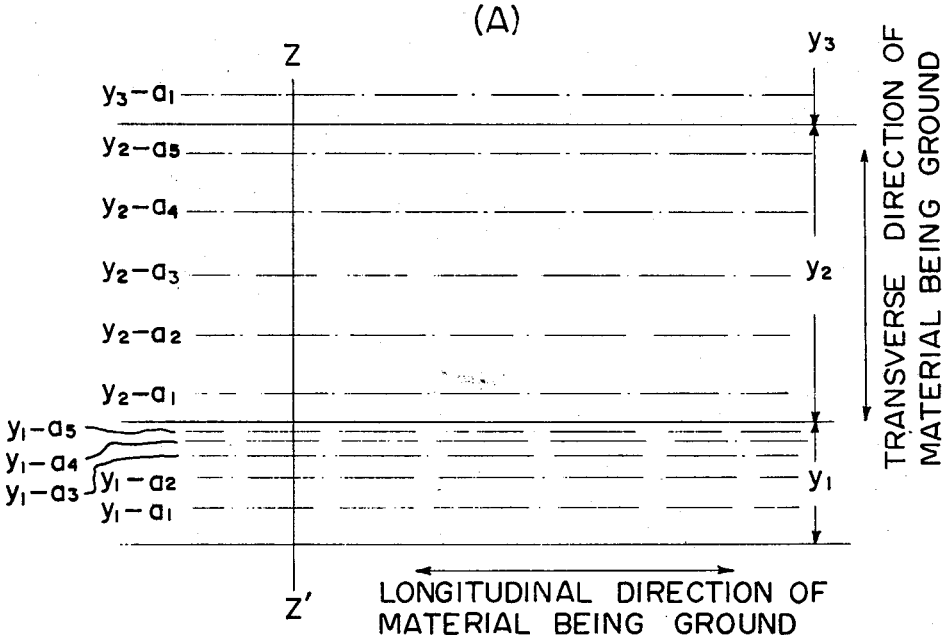
FIG. 6(A) is a partial plan view showing contacting lines or grinding lines between a billet being deseamed and a grinding wheel.
FIG. 6(B) is a sectional view taken along the line Z — Z′ of FIG. 6(A) showing the contacting relationships between the billet and the grinding wheel.
Figure 6:
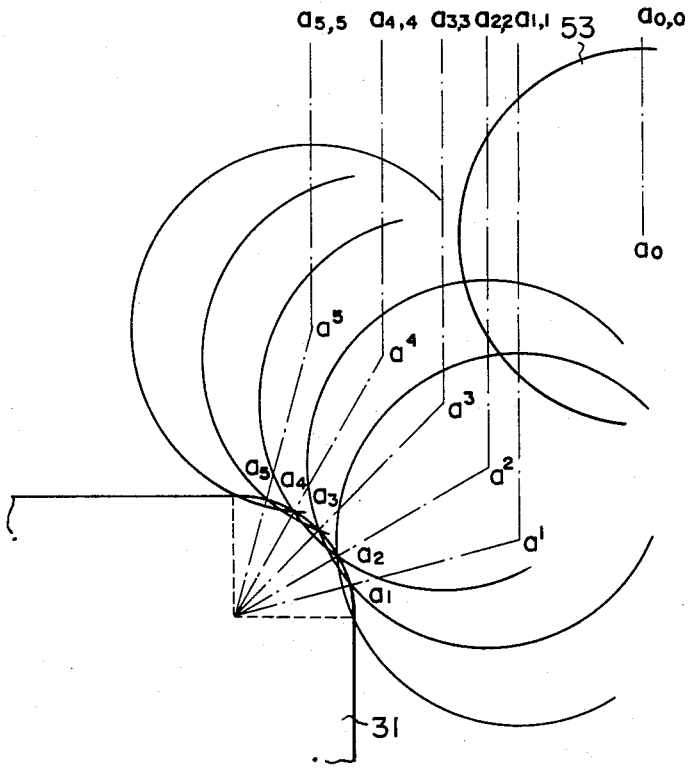

In the FIGS. 6(A) and 6(B) there are shown contacting lines or grinding lines between the billet and the grinding wheel. In this embodiment, the billet is a rectangular bar having a width of 150 mm. Taking into account the grinding width and depth of the grinding wheel used, five grindings lines $a_1$ through $a_5$ for each width of $\Delta y$ are set to be included, as shown in FIGS. 6(A) and (B). If the width of the billet is smaller, the number of grinding lines may be reduced. Moreover, if the grinding depth should be made larger, the number of grinding lines should also be reduced, since the larger the grinding depth is made, the larger the grinding width becomes.

Grinding operation will now be described in greater detail by way of example in connection with the defect $F_0$ as shown in FIG. 4.

Assuming that the grinding wheel 53 is positioned as indicated by reference character $a_0$ in FIG. 6(B) upon completing of the previous grinding cycle. The main controller $C_1$ transmits a grinding wheel carriage advancing signal $S_2^1$ through an interface $C_6$ to operate an oil pressure cylinder 59 to thereby advance the grinding wheel 53 so that the center of the grinding wheel 53 may be aligned with the lateral position of the defect marking $F_0$ or the grinding line $y_1 - a_{1,1}$. Whether or not the center of the grinding wheel is aligned with the grinding line $y_1 - a_{1,1}$ can be detected by monitoring lateral position signals $U_3$ which the main controller $C_1$ receives from a grinding wheel carriage position detector 56 (see FIG. 5(A)) through an interface $C_7$. In this servo system, as soon as the center of the grinding wheel is aligned with the grinding line $y_1 - a_{1,1}$, the mail controller $C_1$ produces a grinding wheel carriage stopping signal $S_2^0$ to stop the grinding wheel carriage from moving. Subsequently, the main controller $C_1$ feeds a rightward moving signal $S_1^1$ to the driver M for the platform car 32 to move the platform car 32 to the right so that the center of the grinding wheel 53 may be aligned with the $x_2$ portion (see FIG. 4) of the defect marking $F_0$ which has been closer to the grinding wheel 53. Similarly to the positioning of the grinding wheel with respect to the grinding line $y_1 - a_{1,1}$ as described above, whether or not the center of the grinding wheel is aligned with the $x_2$ portion of the defect marking $F_0$ can be detected by monitoring longitudinal position signals $U_2$ which the main controller $C_1$ receives from the platform car position detector 38 through the interface $C_4$. As soon as the center of the grinding wheel is aligned with the $x_2$ portion of the defect marking $F_0$, the main controller $C_1$ outputs a grinding wheel press down signal $S_3^1$ to press the grinding wheel 53 against the $x_2$ portion of the defect marking $F_0$. Subsequently, the grinding wheel is moved leftwards along the grinding line $y_1 - a_{1,1}$ to perform grinding until it comes to the $x_4$ portion of the defect marking $F_0$. When the grinding wheel reaches the $x_4$ portion of the defect marking $F_0$, the main controller $C_1$ receives a longitudinal position signal $U_2$ from the platform car position detector 38 through the interface $C_4$ and then generates a rightward moving signal $S_1^2$ to initiate the opposite directional or rightward movement of the grinding wheel. Then, the grinding wheel is moved rightwards along the grinding line $y_1$-$a_{1,1}$ to perform grinding until it comes to the $x_1$ portion of the defect marking $F_0$. When the grinding wheel reaches the $x_1$ portion of the defect marking $F_0$, the main controller $C_1$ produces a platform car stopping signal $S_1^0$ to stop the platform car from moving, if the number of times of grinding has been set to one time only. If the number of times of grinding is set to two or more times, such a grinding cycle should be repeated accordingly. Although the number of times of grinding is represented as the number of times of reciprocation of the grinding wheel in this embodiment, it should be noted that the number of times of grinding may be represented as the number of times of forward movement of the grinding wheel plus the number of times of backward movement of the grinding wheel.

Grinding actions for the grinding lines $y_0$ - $a_{2,2}$, $y_0$ - $a_{3,3}$, $y_0$ - $a_{4,4}$ and $y_0$ - $a_{5,5}$ can be successively carried out similarly. Moreover, similar grinding for the other corner edge and flat surface of the billet can be performed similarly. It should be noted that the number of times of grinding in the flat surface of the billet is preferably set to be larger than that in the corner edges of the billet. Similar grinding for the remaining surfaces of the billet can be effected to complete the deseaming for the entire of the billet.

Although in the embodiment described above the billet is in the form of a rectangular bar, this invention may be similarly applied to a round bar billet. In such application, polar coordinate is preferably used to represent segmented areas of the peripheral surface of the round bar billet, in place of Y-coordinate as in the rectangular bar billet.

As described above, according to the principle of this invention, informations or data representative of the positions of all of defect markings which are within the entire surface of a billet being deseamed can be stored in a memory before the grinding operation is actually started. By utilizing the informations stored in the memory, it is possible to continuously carry out longitudinal grinding for all of the defects within the entire surface of the billet without the necessity of screw-driving the billet. Therefore, according to the automatic surface defect grinding apparatus of this invention, defective portions on a billet can be automatically and efficiently ground under a completely unattended condition, thereby resulting in less labor necessary for deseaming.

In the field of detecting defects on a billet, it is known to apply to a defective portion on the billet a defect marking of a chalk having a color different from that of the surface of the billet (for example, if the color of the billet is black, white chalk is used), illuminate the billet and identify the defect marking by detecting the difference between the reflection factors of the billet surface and the color chalk marking by means of, for example a photoconductive semiconductor element which can convert the difference into an electric signal representative of the existence of the defect. However, generally, oil particles tend to be deposited on the surface of the billet and the surface of the billet tends to be rust colored. Furthermore, during conveying of billets from the rolling zone to the inspecting zone and from the inspecting zone to the deseaming zone, the surfaces of the billets tend to be partially ground due to collision or friction between the billets, thereby partially exhibiting a bright color different from the color of the texture of the billet. The known detecting method as described above tends to erroneously detect such oil particles deposited on the billet surface, such rustcolored portions of the billet surface and such bright colored ground portions of the billet surface.

According to this invention, such disadvantage can be eliminated. In detecting defects according to this invention, as described above, a defect marking of a material containing a fluorescent pigment is applied to a defective portion of the billet surface. In a darkroom, ultraviolet rays are projected onto the billet surface to excite the fluorescent pigment of the defect marking so as to generate fluorescent radiation. The defect can be detected by detecting such fluorescent radiation through a filter. This method makes it possible to more accurately detect defects on billets.

We claim:

1. An automatic deseaming apparatus for removing defects from an elongate block of metallic material comprising:

a defect marking detector for detecting defect markings applied to defects on the surface of said block, said defect markings consisting of a material containing a flourescent pigment;

a defect marking position detector;

a grinding controller responsive to said defect marking detector and said defect marking position detector for formulating first data representative of the positions of portions of said detected defect markings;

a memory for storing said first data representative of said detected defect markings, said grinding controller being further responsive to compile from said stored first data second data representative of the positions of each entire marked defect and for formulating grinding sequence data from said compiled second data, said sequence data enabling a grinding wheel to successively move to all marked defects in a minimum of time; and, a grinding wheel for reciprocally grinding each said defect in the direction of the longitudinal axis of said block, said grinding wheel being responsive to said grinding sequence formulated by said grinding controller.

2. An automatic deseaming apparatus as claimed in claim 1 wherein said defect marking detector comprises means for emitting ultraviolet rays to the surface of said block, a detecting plane consisting of a plurality of photoreceptor elements spaced in alignment with one another, and a lens system for imaging the surface of said block onto said detecting plane.

3. An automatic deseaming apparatus as claimed in claim 1, further including a platform car for carrying said block, wherein said defect marking position detector comprises a coding plate provided at one side of said platform car and being movable together with said platform car and a platform car position detector for reading out the codes in said coding plate to determine the longitudinal position of said platform car.

4. An automatic deseaming apparatus as claimed in claim 1, further including a platform car for carrying said block and a carriage for carrying a grinding wheel, wherein said defect marking detector comprises means for emitting ultraviolet rays to the surface of said block, a detecting plane consisting of a plurality of photoreceptor elements spaced in alignment with one another, and a lens system for imaging the surface of said block onto said detecting plane, said defect marking position detector comprising a coding plate provided at one side of said platform car and being movable together with said platform car and a platform car position detector for reading out the codes in said coding plate to determine the longitudinal position of said platform car, said grinding controller comprising a main controller, an interface for receiving defect marking detecting signals from said photoreceptor elements of said detecting plane and feeding them to said main controller, an interface for receiving platform car position signals from said platform car position detector and feeding them to said main controller, said main controller being adapted to process said signals so as to provide said first data representative of the positions of the detected defect markings and feed said first data to said memory, said main controller also being adapted to compile said second data from said first data and formulate said grinding sequence data, an interface for receiving said grinding sequence data from said main controller and feeding a signal to the driver of said platform car for positioning said platform car, and an interface for receiving said grinding sequence data from said main controller and feeding a signal to the driver of said grinding wheel carriage for positioning said grinding wheel.

* * * * *